US005545062A

United States Patent [19]

Takagishi et al.

[11] Patent Number: 5,545,062

[45] Date of Patent: Aug. 13, 1996

[54] TERMINAL FOR PASSING THROUGH WATERPROOF RUBBER PLUG AND METHOD OF PRODUCING TERMINAL

[75] Inventors: Takashi Takagishi; Toshihiko Makita, both of Shizuoka, Japan

[73] Assignee: Yazaki Corporation, Tokyo, Japan

[21] Appl. No.: 352,107

[22] Filed: Nov. 30, 1994

[30] Foreign Application Priority Data

Nov. 30, 1993 [JP] Japan ..... 5-299884

[51] Int. Cl.[6] ..... H01R 4/10

[52] U.S. Cl. ..... 439/877; 439/275; 439/885

[58] Field of Search ..... 439/877, 883, 439/374, 271, 274, 275, 885

[56] References Cited

U.S. PATENT DOCUMENTS

| | | | |
|---|---|---|---|
| 3,937,545 | 2/1976 | Carins et al. | 439/272 |
| 4,717,356 | 1/1988 | Rahrig et al. | 439/275 |
| 4,772,231 | 9/1988 | Hayes | 439/272 |
| 4,921,437 | 5/1990 | Cooper et al. | 439/275 |

FOREIGN PATENT DOCUMENTS

| | | |
|---|---|---|
| 60-162388 | 10/1985 | Japan . |
| 62-198064 | 9/1987 | Japan . |
| 62-241277 | 10/1987 | Japan . |

*Primary Examiner*—David L. Pirlot

*Attorney, Agent, or Firm*—Sughrue, Mion, Zinn, Macpeak & Seas

[57] ABSTRACT

Beveled, chamfered portions are formed at one or both of front and rear ends of each of projected portions including a box-like electrical contact portion and wire-clamping portions, or all of edges of a terminal. A slanting wall, slanting in a direction of withdrawal of the waterproof rubber plug, is provided at a rear side of the projected portion. Annular protective portions are provided adjacent to front and rear ends of the conductor-clamping portion, respectively, the annular protective portions being larger in outer diameter than raised front and rear ends of the conductor-clamping portion after compressive clamping of the conductor-clamping portion. A generally semi-annular projection for preventing an inverted insertion of the terminal is provided at a bottom plate portion of the terminal, and an arch-like curved portion, extending in a direction of the width of the terminal, is formed at an apex portion of the projection. An electrically-conductive metal sheet is shaped by bending in such a manner that burrs, formed at blanked edges of the electrically-conductive metal sheet, are projected inwardly from the terminal.

4 Claims, 8 Drawing Sheets

FIG. 15(a)
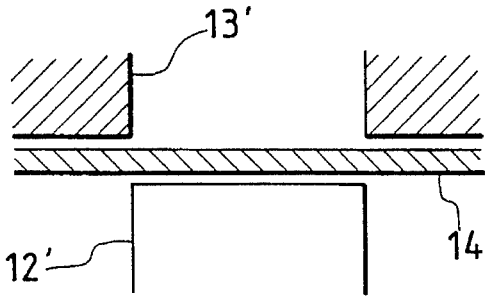
FIG. 15(b)
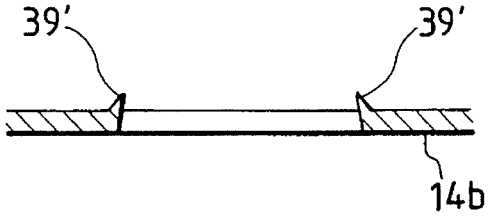
FIG. 16(a)
FIG. 16(b)
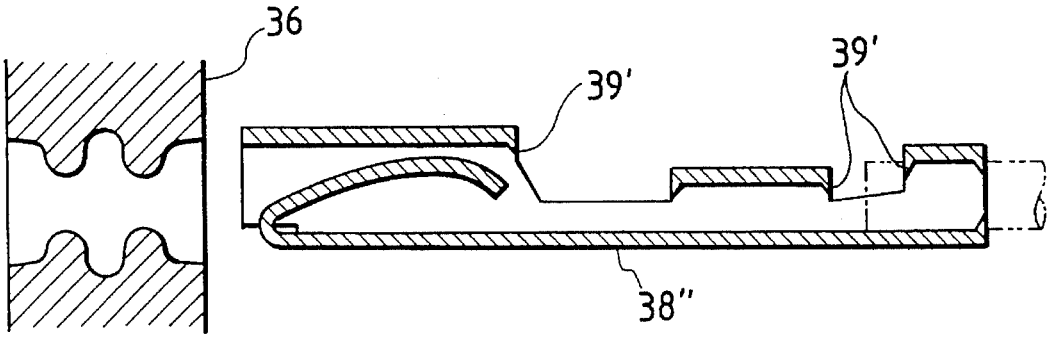

FIG. 17(a)
FIG. 17(b)
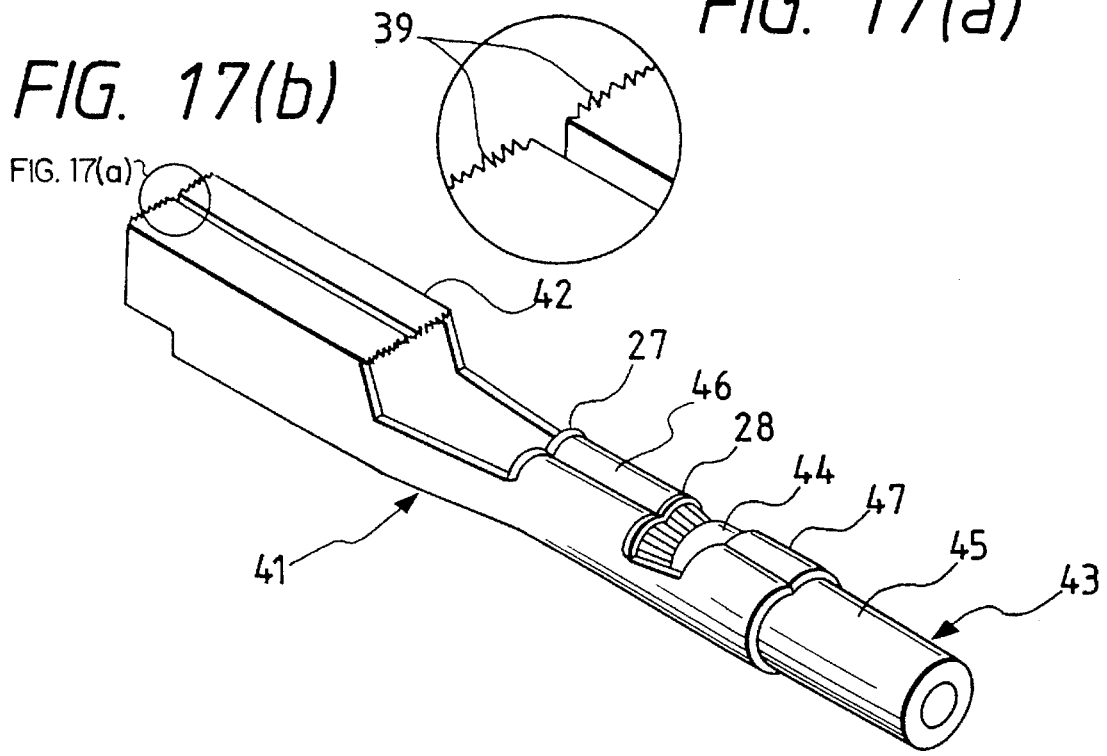
FIG. 18(a)
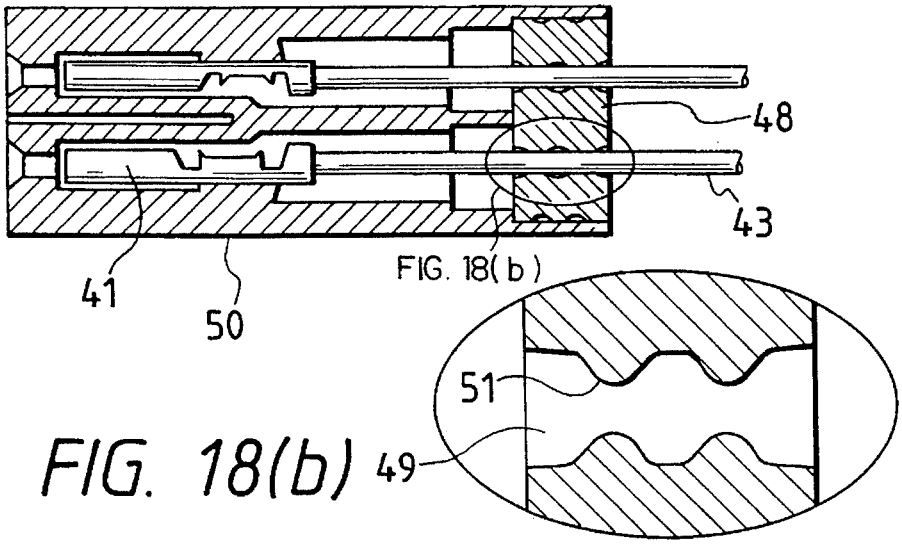
FIG. 18(b)

TERMINAL FOR PASSING THROUGH WATERPROOF RUBBER PLUG AND METHOD OF PRODUCING TERMINAL

BACKGROUND OF THE INVENTION

1. Field of the invention

This invention relates to a terminal for passing through a waterproof rubber plug, which has no burr at an end thereof, and has a slanting portion so that the terminal can be smoothly passed through and disengaged from the waterproof rubber plug without damage to the waterproof rubber plug. The invention also relates to a method of producing such a terminal.

2. Related art

FIG. 17 shows a conventional terminal, and FIG. 18 shows a waterproof connector using these terminals (Japanese Utility Model Unexamined Publication No. 60-162388).

The terminal 41 is formed by blanking an electrically-conductive metal sheet by a die and then by bending this blank piece. The terminal includes a box-like (tubular and rectangular in cross-section) electrical contact portion 42 for receiving a mating tab terminal, a conductor-clamping portion 46 for compressively clamping a conductor 44 of a wire 43, and a covering-clamping portion 47 for compressively clamping a covering 45 of the wire 43.

The terminal 41 is passed through an insertion hole 49 in a waterproof rubber plug 48, and is inserted into a connector housing 50, as shown in FIG. 18. The waterproof rubber plug 48 is in the form of a flat mat, and has a plurality of insertion holes 49. Seal lips 51 are formed on an inner surface of the insertion hole 49, and these seal lips 51 closely fit on the wire 43 to thereby prevent the intrusion of water from the exterior.

In the above conventional terminal 41, however, burrs 39 are formed at the ends of the terminal during the blanking by the die, as shown on an enlarged scale in FIG. 17, and sharply-raised portions (bell mouths) 27 and 28 are formed respectively at the front and rear ends of the conductor-clamping portion 46 during the compressive clamping. This has resulted in a problem that such burrs and raised portions damage the lips 51 of the waterproof rubber plug 48 and prevent a smooth insertion of the wire.

SUMMARY OF THE INVENTION

With the above problem in view, it is an object of this invention to provide a terminal for passing through a waterproof rubber plug, which prevents the waterproof rubber plug from being damaged by burrs, formed during blanking, and sharply-raised portions formed during compressive clamping of a conductor, so that the terminal can be smoothly passed through and disengaged from the rubber plug. Another object of the invention is to provide a method of producing such a terminal.

The above objects have been achieved by a terminal of a first construction wherein the terminal has projected portions including a box-like electrical contact portion and wire-clamping portions, and beveled, chamfered portions are formed at one or both of front and rear ends of each of the projected portions, or all of edges of the terminal; a second construction in which a slanting wall, slanting in a direction of withdrawal of the waterproof rubber plug, is provided at a rear side of a projected portion such as a box-like electrical contact portion; a third construction in which annular protective portions are provided adjacent to front and rear ends of a conductor-clamping portion, respectively, the annular protective portions being larger in outer diameter than raised front and rear ends of the conductor-clamping portion after compressive clamping of the conductor-clamping portion; and a fourth construction in which a generally semi-annular projection for preventing an inverted insertion of the terminal is provided at a bottom plate portion of the terminal, and an arch-like curved portion, extending in a direction of the width of the terminal, is formed at an apex portion of the projection. Further, there is provided a method of producing a terminal wherein an electrically-conductive metal sheet is blanked by a press, and a resulting metal sheet blank is shaped by bending to form the terminal, and the electrically-conductive metal sheet blank is shaped by bending in such a manner that burrs, formed at blanked edges of the electrically-conductive metal sheet blank, are projected inwardly from the terminal.

In the above first construction, when the terminal is to be passed through the waterproof rubber plug, the terminal can smoothly slide relative to an insertion hole in the waterproof rubber plug because of the provision of the chamfered portion at the front end of the projected portion. When the terminal is to be withdrawn from the rubber plug, a similar effected is achieved by the chamfered portion provided at the rear end of the projected portion. In the second construction, the slanting wall provided in the direction of withdrawal of the waterproof rubber plug achieves a similar effect. In the third construction, the front and rear annular protective portions prevent the interference of the raised front end rear ends of the compressively-clamped conductor-clamping portion with the waterproof rubber plug. In the fourth construction, the arch-like curved portion slidingly contacts the rubber plug, and the edge of the projected portion will not contact the rubber plug. In the terminal production method, the burrs, formed during the blanking operation, are directed inwardly, so that the burrs are prevented from interfering with the waterproof rubber plug.

BRIEF DESCRIPTION OF THE DRAWINGS

FIGS.15(*a*) and 15(*b*) are cross-sectional views showing a blanking method according to the present invention;

FIG. 16(*a*)illustrates the plug in cross-section;

FIG. 16(*b*) is a vertical cross-sectional view showing the condition of production of burrs in the method of the present invention;

FIG. 17 is a perspective view of a conventional terminal; and

FIG. 18 is a vertical cross-sectional view of a waterproof connector having the conventional terminals inserted therein.

DETAILED DESCRIPTION OF THE PREFERRED EMBODIMENTS

Figure 1:
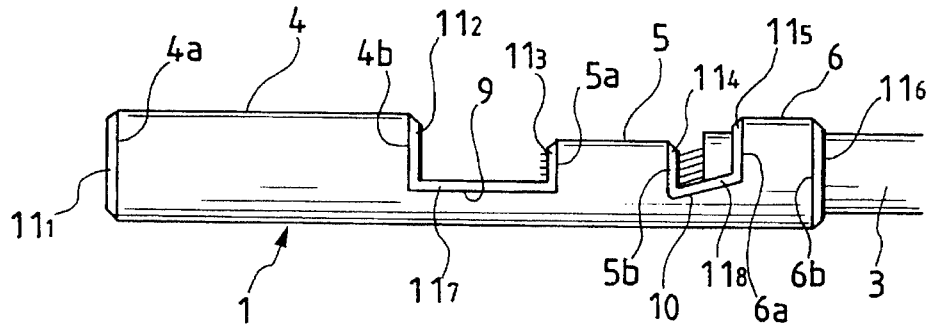
FIG. 1 is a front-elevational view of a first embodiment of a terminal (female terminal) of the present invention for passing through a waterproof rubber plug.

FIG. 1 shows one preferred embodiment of a terminal of the prevent invention for passing through a waterproof rubber plug.

This terminal 1. like the conventional terminal, projected portions, that is, a box-like (tubular and rectangular in cross-section) electrical contact portion 4 for a mating tab terminal 2 (see FIG. 2), a conductor-clamping portion 5 for a wire 3 and a covering-clamping portion 6 for the wire 3. In order to smoothly pass these projected portions 4 to 6 through an insertion hole 8 in a waterproof rubber plug 7 (see FIG. 4), chamfered portions $\mathbf{11}_1$ to $\mathbf{11}_8$, which are beveled in an outwardly-tapering manner or in a curved manner, are formed respectively at front and rear ends 4*a* and 4*b* of the electrical contact portion 4, front and rear ends 5*a* and 5*b* of the clamping portion 5, front and rear ends 6*a* and 6*b* of the clamping portion 6, and the other edges of the terminal (that is, the edges on a connecting portion 9 interconnecting the electrical contact portion 4 and the conductor-clamping portion 5, and the edges on a connecting portion 10 interconnecting the conductor-clamping portion 5 and the covering-clamping portion 6).

The chamfered portions 11 ($\mathbf{11}_1$, $\mathbf{11}_3$, $\mathbf{11}_5$) may be provided only at the front end 4*a* of the electrical contact portion 4 and the front ends 5*a* and 6*a* of the clamping portions 5 and 6, in which case the terminal 1 can be smoothly passed through the waterproof rubber plug 7 without damage thereto. If the chamfered portions $\mathbf{11}_2$, $\mathbf{11}_4$ and $\mathbf{11}_6$ are formed respectively at the rear end 4*b* of the electrical contact portion 4 and the rear ends 5*b* and 6*b* of the clamping portions 5 and 6, the terminal 1 can be smoothly disengaged from the waterproof rubber plug 7 without damage thereto.

Figure 2:
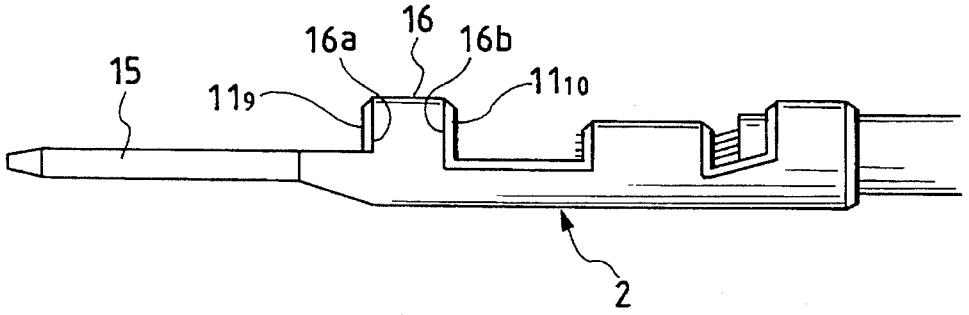
FIG. 2 is a front-elevational view of a male terminal.
Figure 13A:
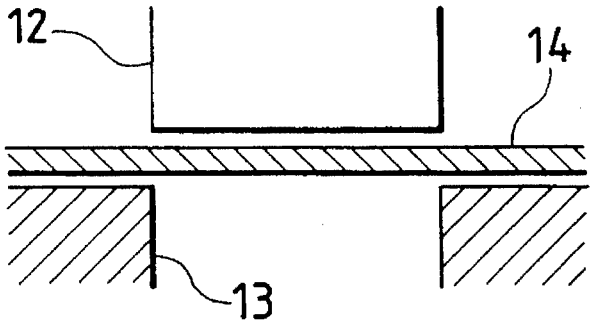
FIGS. 13(*a*) and 13(*b*) are cross-sectional views showing a blanking step (conventional method)
Figure 13B:
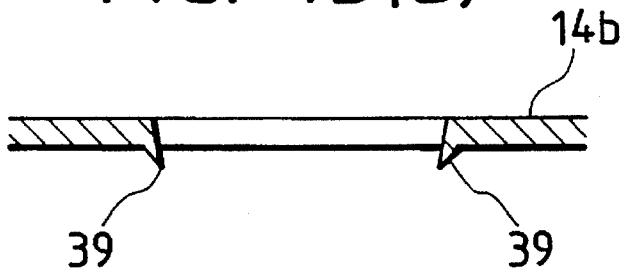

The chamfered portions 11 can be formed, for example, by stamping the edges of the terminal 1 during the blanking operation in which the terminal 1 in a developed formed is blanked from an electrically-conductive metal sheet 14 by dies 12 and 13 (see FIG. 13). Such chamfered portions 11, formed on the female terminal 1, can also be formed respectively at front and rear ends 16*a* and 16*b* of a box-like retaining portion 16 of the male terminal 2 having a front tab 15, as shown in FIG. 2.

Figure 3:
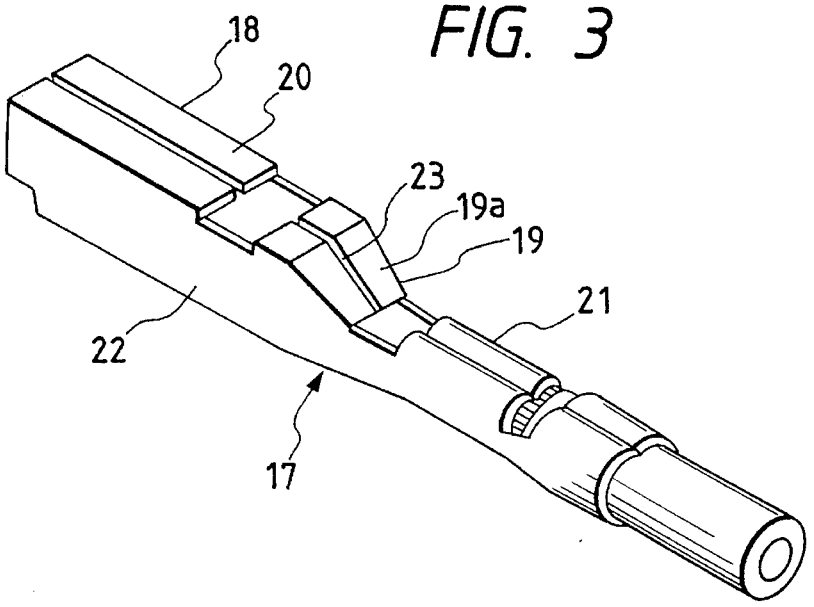
FIG. 3 is a perspective view of a second embodiment of a terminal of the present invention for passing through a waterproof rubber plug.

FIG. 3 shows a second embodiment of a terminal of the present invention for passing through a waterproof rubber plug.

Figure 4:
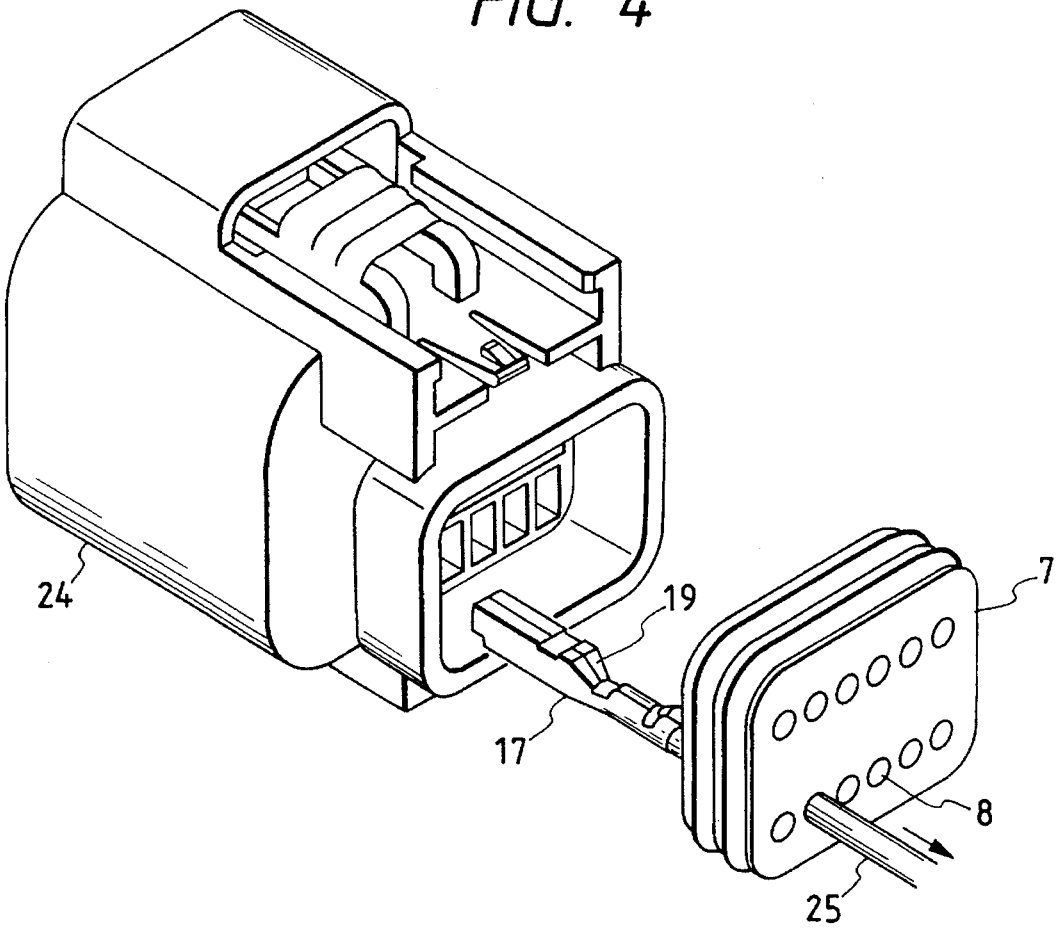
FIG. 4 is an exploded perspective view showing the manner of withdrawing the terminal from the waterproof rubber plug.

In this terminal 17, a slanting wall 19, having an upwardly-tapering surface 19a, is provided at a rear end of a box-like electrical contact portion 18 which is the largest projected portion, so that the terminal can be smoothly moved in a terminal-withdrawing direction to be disengaged from the insertion hole 8 in the waterproof rubber plug 7, as shown in FIG. 4.

The slanting wall 19 extends obliquely from a rear end of a top wall 20 of the box-like electrical contact portion 18 toward a front end of a conductor-clamping portion 21, and is continuous with side walls 22 of the box-like contact portion 18. The top wall 20, as well as the slanting wall 19, is formed by bending a pair of right and left portions extending respectively from the side walls 22, and has a slit 23 at its central portion.

As shown in FIG. 4, the waterproof rubber plug 7 with the terminal 17 having a wire 25 connected thereto is disengaged from a connector housing 24, and then the wire 25 is pulled, so that the slanting wall 19 is slidingly contacted with and guided by the front end portion of the insertion hole 8 in the waterproof rubber plug 7, and therefore the terminal 17 can be smoothly withdrawn.

Figure 5:
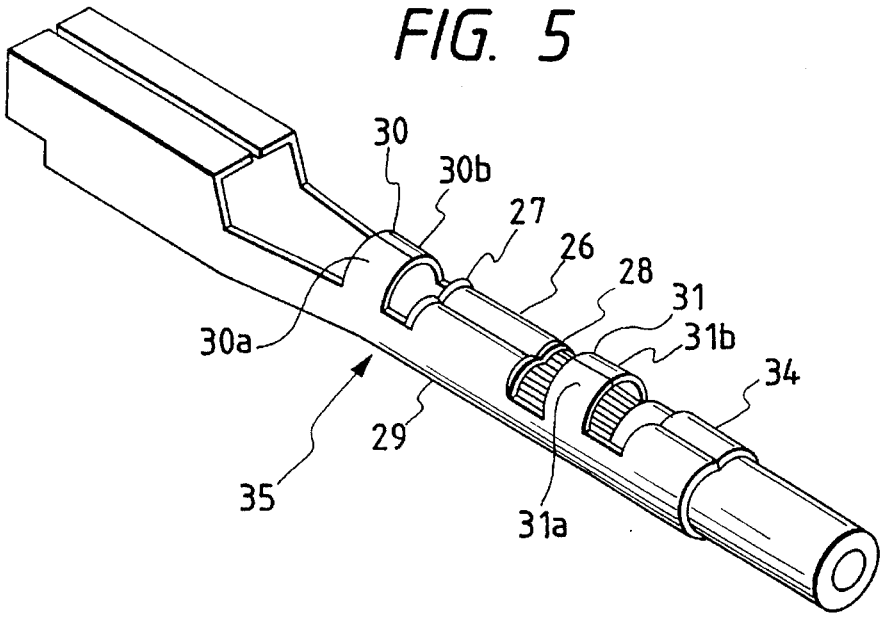
FIG. 5 is a perspective view of a third embodiment of a terminal of the present invention for passing through a waterproof rubber plug.
Figure 6:
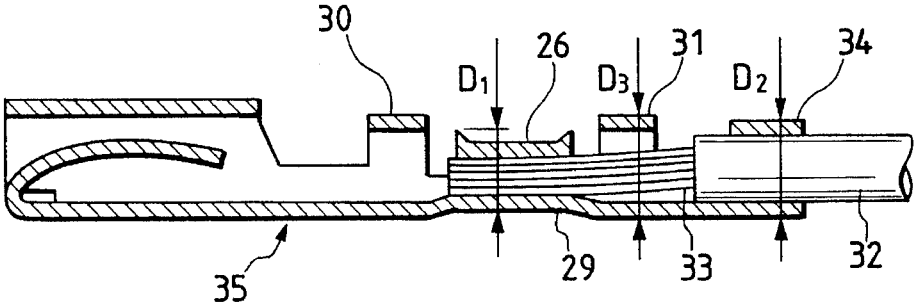
FIG. 6 is a vertical cross-sectional view of the terminal.
Figure 7:
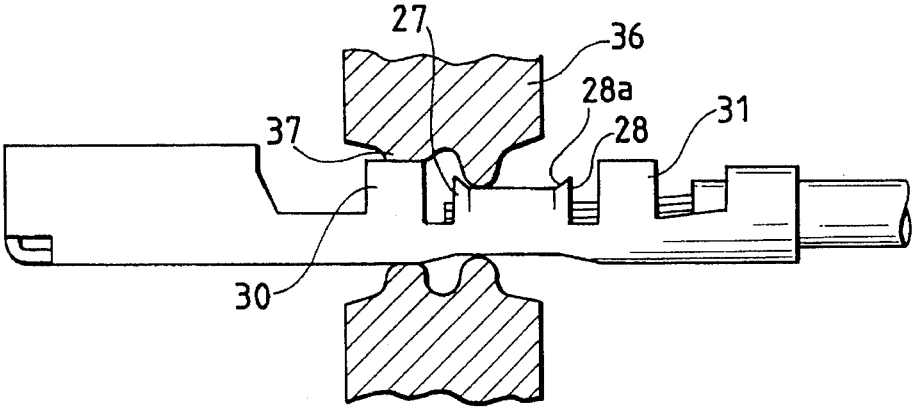
FIG. 7 is a cross-sectional view showing a condition in which the terminal is passed through the waterproof rubber plug.

FIGS. 5 to 7 shows a third embodiment of a terminal of the present invention for passing through a waterproof rubber plug.

In order to prevent a waterproof rubber plug 36 (FIG. 7) from being damaged by sharply-raised portions (bell mouths) 27 and 28 which are formed respectively at front and rear ends of a conductor-clamping portion 26 during compressive clamping of a wire (This is one problem with the conventional construction), annular protective portions 30 and 31 are formed on a base plate portion 29 of the terminal, and are disposed adjacent to the front and rear ends of the conductor-clamping portion 26, respectively, the annular protective portions 30 and 31 having an outer diameter larger that the outer diameter $D_1$ of the raised portions of the conductor-clamping portion 26.

Each of the annular protective portions 30 and 31 is formed by bending a pair of portions 30*a* and 30*b* (31*a* and 3l*b*), extending from the terminal base plate portion 29 along the conductor-clamping portion 26, into an annular configuration by a clamping jig (not shown), with the distal ends of the pair of portions joined together. As shown in FIG. 6, each of the annular protective portions 30 and 31 does not contact a conductor 33 of the wire 32, and has the outer diameter $D_3$ slightly larger than the outer diameter $D_1$ of the conductor-clamping portion 26 and the outer diameter $D_2$ of a covering-clamping portion 34. If the rearwardly-disposed covering-clamping portion 34 is provided close to the conductor-clamping portion 26, this covering-clamping portion 34 can perform the function of the rear annular protective portion 31.

When this terminal 35 is to be passed through the waterproof rubber plug 36, the front annular protective portion 30 forces a seal lip 37 upwardly, so that this seal lip 37 passes above the forwardly-projected, sharply-raised portion 27, thereby preventing damage to this seal lip 37. This seal lip 37 is smoothly engaged with the rear annular protective portion 31 along a rear slanting surface 28*a* of the rear raised portion 28. When the terminal 35 is to be withdrawn from the waterproof rubber plug 36, the rear annular protective portion 31 performs the same function as described above.

FIGS. 8 to 11 shows a fourth embodiment of a terminal of the present invention for passing through a waterproof rubber plug.

Figure 9:
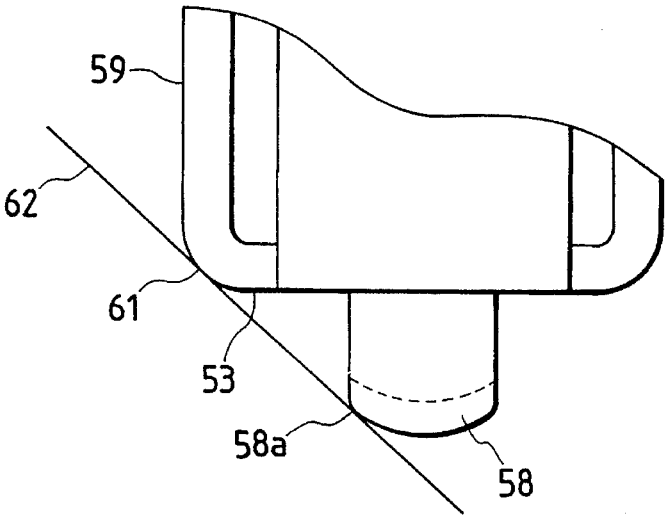
FIG. 9 is a front-elevational view of the terminal.

In this terminal 52, a generally semi-annular projection 54 for preventing an inverted insertion of the 25 terminal is formed on a bottom plate portion 53 by stamping, and an apex portion of the projection 54 is curved into an arch-like configuration in the direction of the width of the terminal, as viewed from the front side in FIG. 9.

Figure 11:
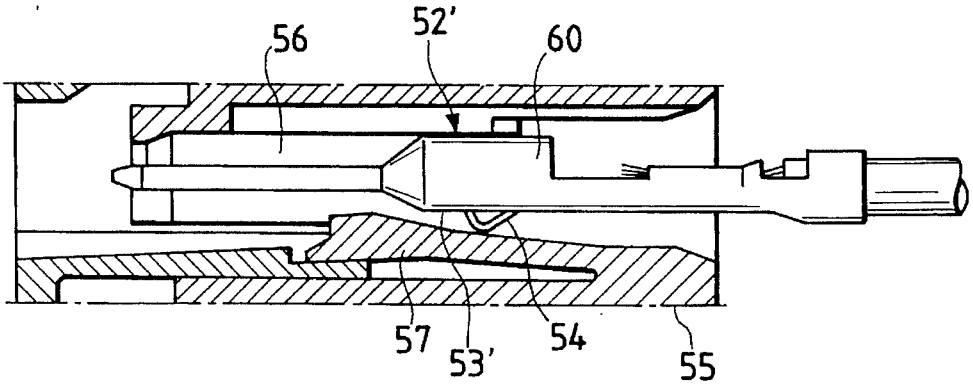
FIG. 11 is a cross-sectional view taken along the line A—A of FIG. 8.

As shown in FIG. 11 showing a male terminal 52' as one example, when the terminal 52' is inserted upside down into a terminal receiving chamber 56 of a connector housing 55, the semi-annular projection 54 abuts against a retaining lance 57, so that the terminal can not be inserted further, thereby preventing such an inverted insertion. An arch-like curved portion 58 is formed at the apex portion of the projection 54 so that an edge of the projection 54 will not damage a waterproof rubber plug when passing the terminal 52, 52' through the rubber plug.

Figure 8:
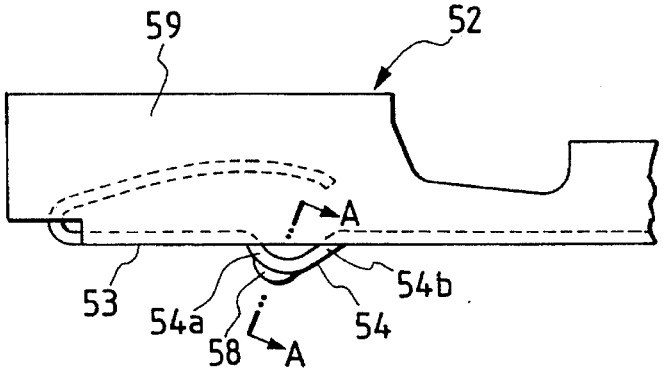
FIG. 8 is a side-elevational view showing a fourth embodiment of a terminal of the present invention for passing through a waterproof rubber plug.
Figure 10:
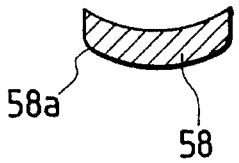
FIG. 10 is a vertical cross-sectional view showing the effect of preventing the terminal from being inserted in an inverted manner.

The projection 54, provided at a box-like electrical contact portion 59 of FIG. 8 or the bottom plate portion 53, 53' of a box-like retaining portion 60 of FIG. 11, is generally semi-annular in the direction of the length of the terminal, and more specifically, a front half 54*a* of this projection is slanting a little more abruptly while a rear half 54*b* is slanting gently. The arch-like curved portion 58 is formed at the apex of the projection 54 and its adjoining portion, and more specifically at the front half 54*a* for contact with the rubber plug when the terminal is passed through the rubber plug, as shown in FIG. 10 which is a cross-sectional view taken along the line A—A of FIG. 8. An arch-like curved surface 58*a* and a curved surface 61 are formed respectively on the projection 54 and the lateral side of the bottom plate portion 53 of the box-like electrical contact portion 59 in such a manner that these curved surfaces 58*a* and 61 are disposed on a tangential line 62, as shown in FIG. 9. This tangential line 62 is regarded as a sliding surface of the rubber plug, and the rubber plug smoothly contacts the curved portion 58 of the projection 54, and will not contact with edges.

FIGS. 12 to 16(*b*) shows one example of a method of producing a terminal of the present invention for passing through a rubber plug.

Figure 12C:
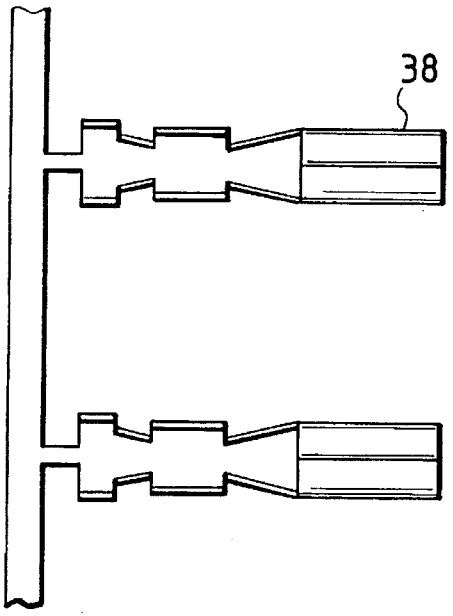
FIGS. 12(*a*) to 12(*c*) are plan views showing sequential steps of one embodiment of a terminal production method of the present invention, respectively.
Figure 12B:
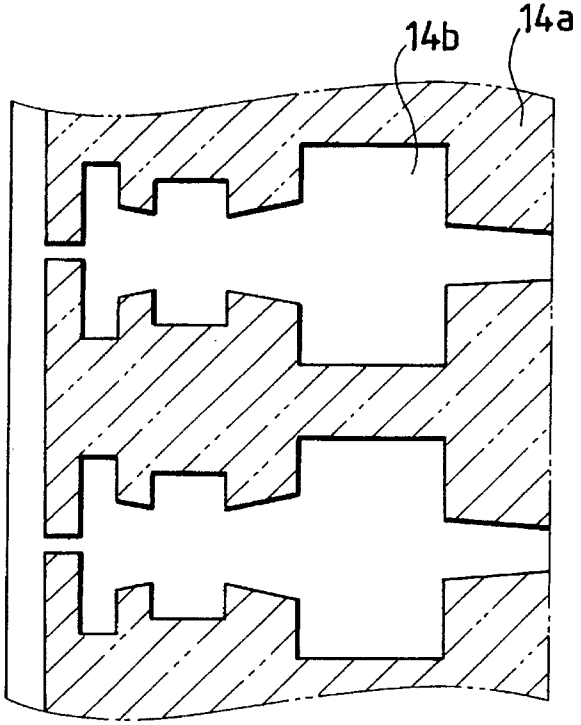
Figure 12A:
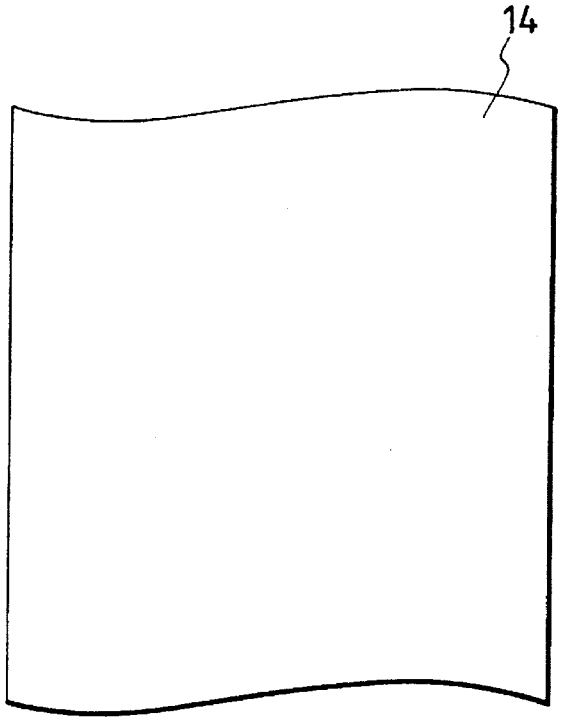
Figure 14:
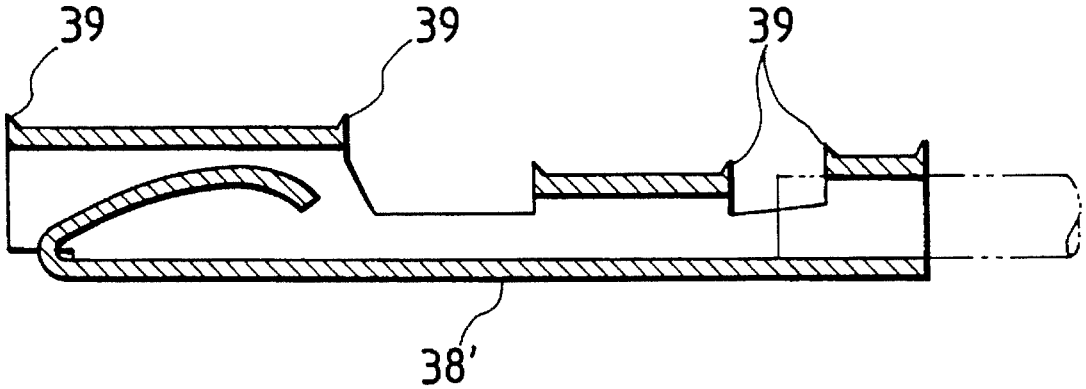
FIG. 14 is a vertical cross-sectional view showing the condition of production of burrs in the conventional method.

As shown in FIGS. 12(*a*) to 12(*c*), terminals 38 are formed in a linked manner by blanking from a single electrically-conductive metal sheet 14 and then by bending. Those portions indicated by hatching in FIG. 12(*b*) are blank portions 14*a*. In the blanking operation, the electrically-conductive metal sheet 14 is placed on a die 13, and is pressed by a punch 12 applied to the upper side of this sheet, as shown in FIG. 13(*a*). With this method, however, burrs 39 are formed on blanked edges of a terminal blank 14*b* at an outer surface thereof, as shown in FIG. 13(*b*), and after the shaping of the terminal, the burrs 39 are projected outwardly from the terminal 38', as shown in FIG. 14. Naturally, these burrs 39 will damage a waterproof rubber plug 36 (FIG. 16*a*).

Therefore, the direction of blanking of the terminal 38' is reversed as shown in FIG. 15(*a*). More specifically, the electrically-conductive metal sheet 14 is positioned over a punch 12', and a die 13' is positioned over the metal sheet 14, so that burrs 39' are projected from an inner surface of a terminal blank 14*b* as shown in FIG. 15(*b*). Thus, after the shaping of the terminal, the burrs 39' are projected inwardly from the terminal 38" as shown in FIG. 16, and will not damage the waterproof rubber plug 36. It is possible to turn over the terminal blank 14*b* shown in FIG. 13(*b*) and then to effect the shaping of the terminal.

As described above, in the present invention, the burrs, produced on the terminal during the blanking of the terminal, are removed by the chamfered portions, and the chamfered portions serve as the guide portions for the waterproof rubber plug, and the resistance, offered by the waterproof rubber plug in the withdrawing direction, is reduced by the slanting wall, and the interference of the sharply-raised front and rear ends of the conductor-clamping portion with the waterproof rubber plug is prevented because of the provision of the annular protective portions. The interference of the edge with the waterproof rubber plug is eliminated by the arch-like curved portion formed on the projection. The burrs, produced during the blanking operation, are directed inwardly. Because of these effects, the terminal can be smoothly passed through and disengaged from the waterproof rubber plug, so that damage to the waterproof rubber plug is prevented. As a result, the waterproofness is ensured, and because of the smooth insertion, the diameter of the insertion hole in the waterproof rubber plug can be smaller, and therefore a more positive sealing effect can be achieved, and also the waterproof rubber plug can be used for the wires of different diameters.

What is claimed is:

1. A terminal for passing through a waterproof rubber plug comprising:

an electrical contact portion for receiving a mating terminal;

a conductor-clamping portion for compressively clamping a conductor of a wire;

a covering-clamping portion for compressively clamping a covering of the wire; and waterproof rubber insertion means for smoothly communicating the terminal with a waterproof rubber plug without damage to the waterproof rubber plug, the waterproof rubber insertion means comprises a generally semi-annular projection for preventing an inverted insertion of the terminal provided at a bottom plate portion of the terminal and an arch-like curve portion, extending in a direction of the width of the terminal, is formed at an apex portion of the projection, and at least one of beveled and chamfered portions which are formed on at least one edge of at least one of the electrical contact portion, the conductor-clamping portion and covering-clamping portion which oppose the rubber plug in an insertion direction of the terminal into the rubber plug.

2. A terminal for passing through a waterproof rubber plug as claimed in claim 1, wherein the waterproof rubber insertion means further comprises a slanting wall, slanting in a direction of withdrawal of the waterproof rubber plug, which is provided at a rear side of at least one of the electrical contact portion, the conductor-clamping portion and covering-clamping portion.

3. A terminal for passing through a waterproof rubber plug as claimed in claim 1, wherein the waterproof rubber insertion means includes annular protective portions which are provided adjacent to front and rear ends of a conductor-clamping portion, respectively, and the annular protective portions is larger in outer diameter than raised front and rear ends of the conductor-clamping portion after compressive clamping of the conductor-clamping portion.

4. A terminal for passing through a waterproof rubber plug as claimed in claim 1, wherein the waterproof rubber insertion means includes a generally semi-annular projection for preventing an inverted insertion of the terminal is provided at a bottom plate portion of the terminal and an arch-like curved portion, extending in a direction of the width of the terminal, is formed at an apex portion of the projection.

* * * * *